US009839280B2

(12) United States Patent
Wingfield

(10) Patent No.: US 9,839,280 B2
(45) Date of Patent: Dec. 12, 2017

(54) BOTTOM OPENING BACK-STRAP-BUCKET WITH AN ADJUSTABLE LEVER

(71) Applicant: Keith J. Wingfield, Jamaica, NY (US)

(72) Inventor: Keith J. Wingfield, Jamaica, NY (US)

( * ) Notice: Subject to any disclaimer, the term of this patent is extended or adjusted under 35 U.S.C. 154(b) by 207 days.

(21) Appl. No.: 15/005,111

(22) Filed: Jan. 25, 2016

(65) Prior Publication Data

US 2016/0227909 A1 Aug. 11, 2016

Related U.S. Application Data

(60) Provisional application No. 62/176,047, filed on Feb. 9, 2015.

(51) Int. Cl.
*A45F 3/04* (2006.01)

(52) U.S. Cl.
CPC ..... *A45F 3/04* (2013.01)

(58) Field of Classification Search
CPC ..... A45F 3/04; A45F 2003/003; A45F 2003/142; A45F 2003/146; A45F 3/08; A45F 3/14
See application file for complete search history.

(56) References Cited

U.S. PATENT DOCUMENTS

| | | | | |
|---|---|---|---|---|
| 7,055,907 | B1 * | 6/2006 | Tilby | A01M 31/02 297/224 |
| 2003/0201273 | A1 * | 10/2003 | Reid | A45C 11/24 220/694 |
| 2005/0011785 | A1 * | 1/2005 | Nish | A45C 3/00 206/315.1 |
| 2010/0219222 | A1 * | 9/2010 | Winneur | A45C 9/00 224/629 |
| 2015/0076202 | A1 * | 3/2015 | Jensen | A45F 3/14 224/645 |
| 2015/0190814 | A1 * | 7/2015 | Barass | B03B 5/26 224/153 |

* cited by examiner

*Primary Examiner* — Corey Skurdal
(74) *Attorney, Agent, or Firm* — Dunlap Bennett & Ludwig PLLC

(57) ABSTRACT

A bottom opening back-strap-bucket with an adjustable lever. A bucket or large container body has a bottom opening, operable by a lever that permits an operator to pick up, carry and deposit items, leaving the operator's hands free when traveling. The invention utilizes leg and upper body strength, which allows the operators hands and arms to rest or be available for other tasks, such as for loading. The invention allows a user to travel anywhere, even hauling or carry heavy items up and down steps or ladders. The lever is operable to open the bottom plate to deposit items carried within the bucket at a selected location.

10 Claims, 4 Drawing Sheets

BOTTOM OPENING BACK-STRAP-BUCKET WITH AN ADJUSTABLE LEVER

CROSS-REFERENCE TO RELATED APPLICATION

This application claims the benefit of priority of U.S. provisional application No. 62/176,047, filed Feb. 9, 2015, the contents of which are herein incorporated by reference.

BACKGROUND OF THE INVENTION

The present invention relates to containers and, more particularly, to containers for carrying objects, such as construction materials, debris, or other materials over a distance or over uneven terrain.

Problems with existing devices, such as the five gallon bucket are that a user typically loads less in a five gallon bucket and has to carry by hands; the user cannot load as much in the bucket, which results in many back-and-forth trips. In addition, it is often difficult for the user to carry the bucket for very long distances, particularly over rough or uneven terrain, such as stadium steps, or construction sites, without resting.

Also if using as a litter bucket, these are typically fitted with a liner which needs to be emptied and replaced when they are full, adding to the costs of use and unreliability of dragging or hauling a plastic trash bag. More expensive alternatives, such as a 32 gallon trash can on wheels, are limited to level areas and are not conducive to steps and other sites with uneven terrain.

As can be seen, there is a need for a man portable receptacle that permits an operator to carry items, hands free, even when hauling or carry heavy items up and down steps or ladders or other uneven terrain.

SUMMARY OF THE INVENTION

In one aspect of the present invention, a portable receptacle, comprises: a receptacle having an first opening defined in a top end and a second opening defined in a bottom end of the receptacle; a bottom plate hingedly attached to the bottom end of the receptacle and operable between a closed position in which the bottom plate closes the second opening defining a cavity within the receptacle, and an open position; a lever assembly pivotally attached to a side of the receptacle and operatively connected to the bottom plate to position the bottom plate between the closed position and the open position; and a padded strap assembly attached between the top end and the bottom end of the receptacle.

In some embodiments of the multi-purpose portable receptacle, the lever assembly may further comprise: a generally U-shaped bar that is pivotally attached to the receptacle at an intermediate portion of a leg of the U-shaped bar; and a coupling member connecting an aft portion of the U-shaped bar and an aft portion of the bottom plate. In some embodiments, the coupling member may comprise a chain. In other embodiments, the coupling member may comprise one of: a strap, a cable, a rope, an arm, or a rod.

In other aspects of the invention, one or more hinges may be attached between a forward end of the bottom plate and a forward end of the receptacle. One or more D-rings may be attached to a top end of the receptacle and a bottom end of the receptacle; and hooks attach a first end of the strap to the D-ring at the top end of the receptacle and a second end of the strap to the D-ring at the bottom end of the receptacle.

The strap assembly may further comprise an adjustable buckle disposed between the first end of the strap and the second end of the strap.

In yet other aspects of the invention, a locking mechanism is operable to secure the lever assembly in the closed position. The locking mechanism may comprise a hook and an eye, wherein the hook is attached to the handle and the eye is attached to the receptacle, the hook being operable between a locked position wherein the hook engages in the eye, and an unlocked position wherein the hook is disengaged from the eye.

In an embodiment of the invention, the handle assembly may further comprise a handle end that is hingedly attached to a forward end of the U-shaped bar and the handle is movable about the hinge between an extended position and a retracted position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hands free man portable receptacle that allows the user to carry extra loads on the user back. The multi-purpose receptacle of the present invention provides a safe and easy way to pick up and carry litter and debris over long distances, in tight areas, uneven terrain and elevated places. Suitable loads for the multi-purpose receptacle can include: sand bags, bricks, broken concrete, litter, dirt, gravel, groceries, and some house hold items.

The present invention solves many problems in difference fields. It is conveniently designed to load and unload items without the requirement of removing the unit from the user's body. The user conveniently straps the unit onto their back and may load whatever objects they want into the unit just by gently tossing it over their back into the unit. Once the user is at a desire location to empty or unload the contents of the unit, the user may simply dump the items out using the lever. Alternatively, the user may take sensitive items out of the container manually.

For example, let say the operator wants to use the unit as a litter bucket. This allows the operator to pick up litter and debris using a special designed dust pan or a specially designed litter stick extension. The operator can pick up litter for a great distance without having to pull or push a large trash can or dragging a large plastic bag around to receive the litter. When the unit is full, the user may position the unit over a large collection receptacle, or dump pile, and empty the contents quickly and conveniently without removing the unit from their back.

The user may operate an adjustable lever that is operatively attached to the bottom of unit. When lever is pulled it opens the bottom of the unit allowing anything inside to fall out. In other words it is like being a human dump truck.

Other devices do not work as well because: User has to carry by hand, user has to make many back-and-forth trips, user has to drag a plastic bag to pick up litter and user has difficulties traveling in tight spaces or rough uneven terrain.

My invention corrects the above issues because it works like a back pack. The user's hands are always free which enhances better balance and body control when hauling or carrying heavy items anywhere even up and down steps, ladders and tight areas.

Figure 1:
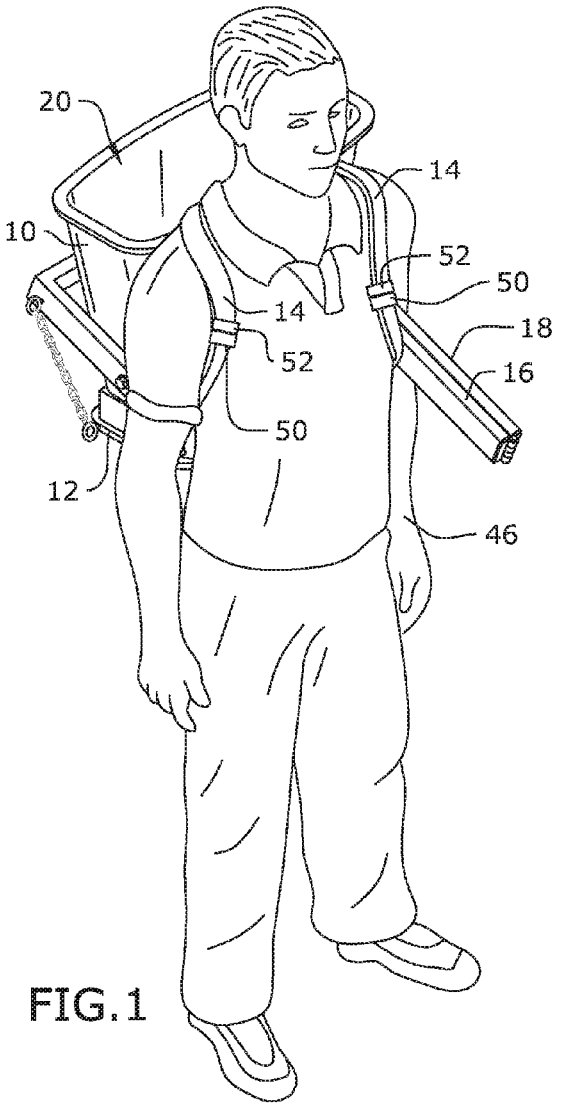
FIG. 1 is a front perspective view of the invention shown in use.
Figure 2:
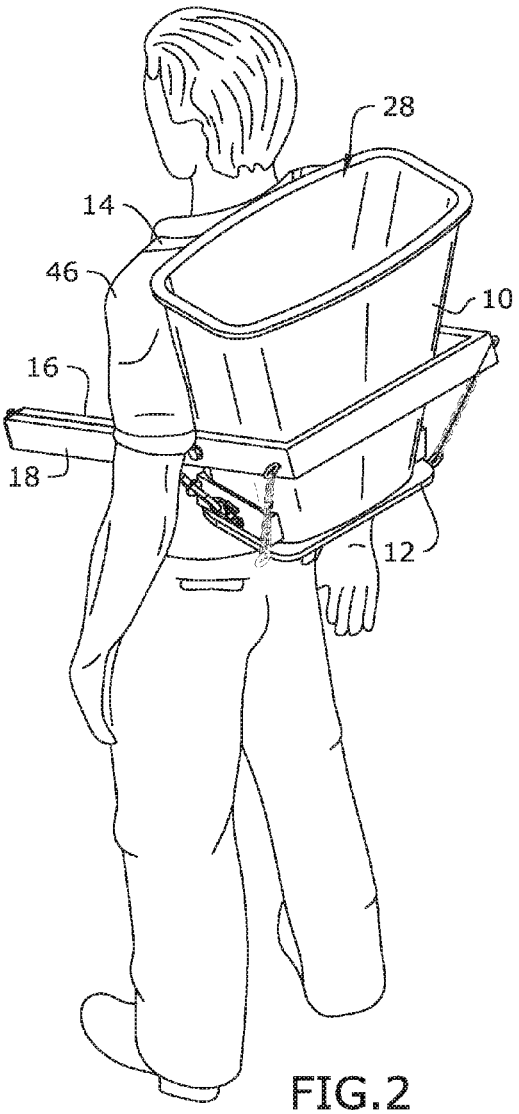
FIG. 2 is a rear perspective view of the invention shown in use.

As best seen in reference to FIGS. 1 & 2, an embodiment of the hands free transport receptacle of the present invention is depicted. The hands free transport receptacle comprises a bucket body 10. The bucket body 10 has an opening at a top end that opens into a bucket cavity 20. A bottom end of the bucket body 10 has a hinged bottom closure 12, operable between a closed, containing position, and an open emptying position. The bottom closure 12 is operable via a handle lever 18 that extends forwardly of the operator 46. The bucket body 10 and bottom closure 12 may be formed from plastics, fiberglass, composites, or other suitable lightweight and rugged formable material.

The bucket body 10 may configured with one or more straps 14 so that the bucket body 10 may be conveniently carried on the operator's 46 back without the need for the operator 46 to use their hands to carry or transport the bucket 10. The operator has the option to load heavy materials into the bucket 10 when the unit is seated on any elevated surface before placing the assembly on their back or may simply load materials, such as litter, construction debris, or other items while the unit is on the operator back by tossing the materials over the operator's 46 shoulder into the bucket cavity 20.

Figure 3:
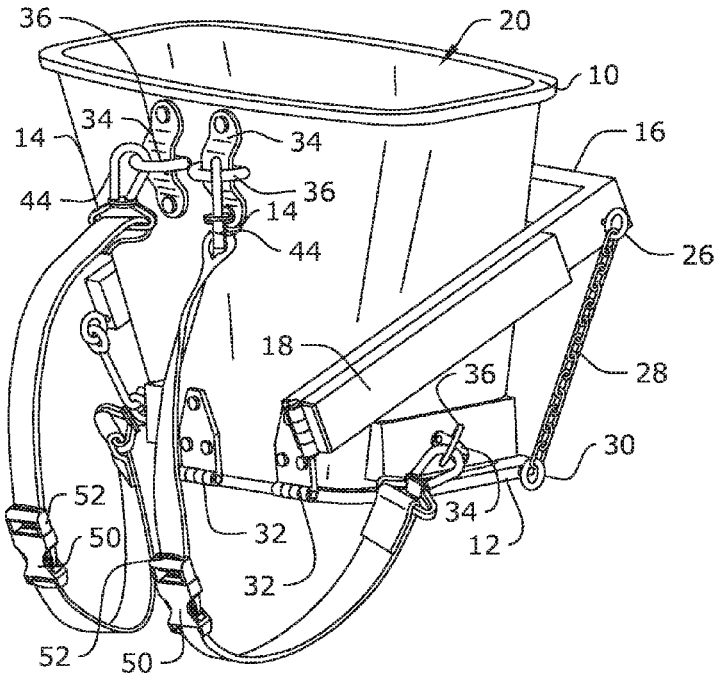
FIG. 3 is a front top perspective view of the invention.
Figure 4:
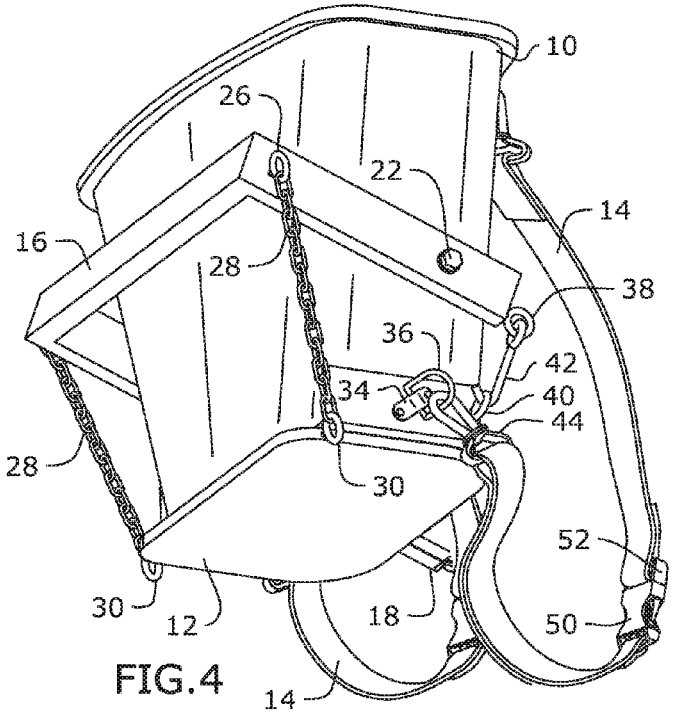
FIG. 4 is a rear bottom perspective view of the invention.

As seen in reference to FIGS. 3 and 4, a preferred embodiment of the invention is shown in which the shoulder straps 14 are operatively attached to the bucket body 10 via a strap clip 44 coupled to a top end of the strap 14. The clip 44 may be removably attached to a D-ring 36 that attached to the bucket body 10 via a clamp, or plate 34. The plate 34, may be attached to the bucket body 10 via a fastener, such as bolts, rivets, or screws. The bottom end of the strap 14 may also be attached to a bottom end of the bucket body 10, via a D-ring 36, attachment plate 34, and fasteners. In a preferred embodiment, the bottom end of the strap 14 attaches above the lower opening and pivoting bottom 12. The carrying straps 14 may also include an adjustable, cooperatively male end 52 and female end 50 buckle closure. The adjustable buckle closure permits the operator 46 to adjust the length of the straps 14 for proper positioning on the operator's back. The buckle is releasable to permit the operator to remove the straps 14. In a preferred embodiment, the straps 14 are padded at the top end near the operator's shoulders.

Figure 5:
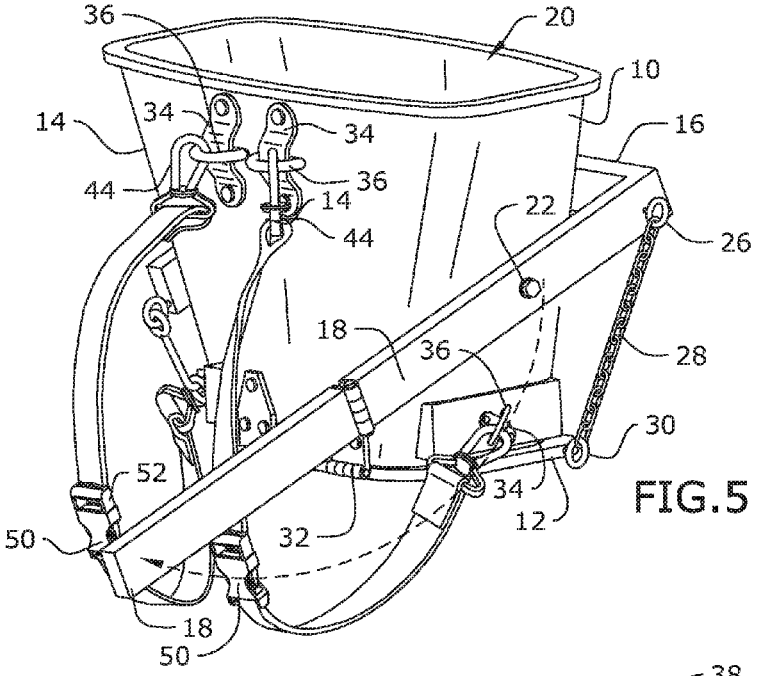
FIG. 5 is a top perspective view of the invention shown with handle lever in extended position.

The handle lever 18 is coupled to a generally U-shaped bar 16 that surrounds the periphery of the bucket body 10. The U-shaped bar 16 may be pivotally attached to the bucket body 10 via a pivot 22 attached to opposed sidewalls of the bucket body 10. In a preferred embodiment, the handle lever 18 may be attached to the U-shaped bar 16 via a hinge, so that the handle may be positioned between a stowed position, shown in FIG. 3, and an extended operating position, shown in reference to FIG. 5.

The U-shaped bar 16 is operatively coupled to the bottom plate 12 via a connecting member 28. The connecting member 28 is attached to an aft end of the U-shaped bar 16. The connecting member 28, may be a chain, a cable, rope, an arm, a rod, or strap. An eye 26 may be used to connect the connecting member 28 to the U-shaped bar 16 and a similar eye 30 may be attached to an aft end of the bottom plate 12.

Figure 6:
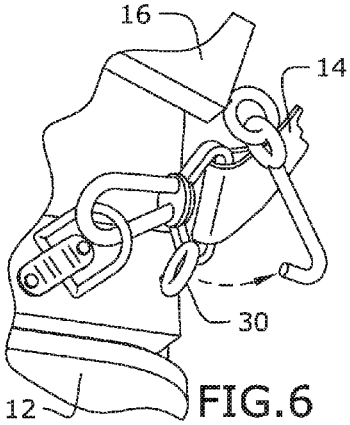
FIG. 6 is a detail perspective view of the invention demonstrated in unlocked configuration.
Figure 7:
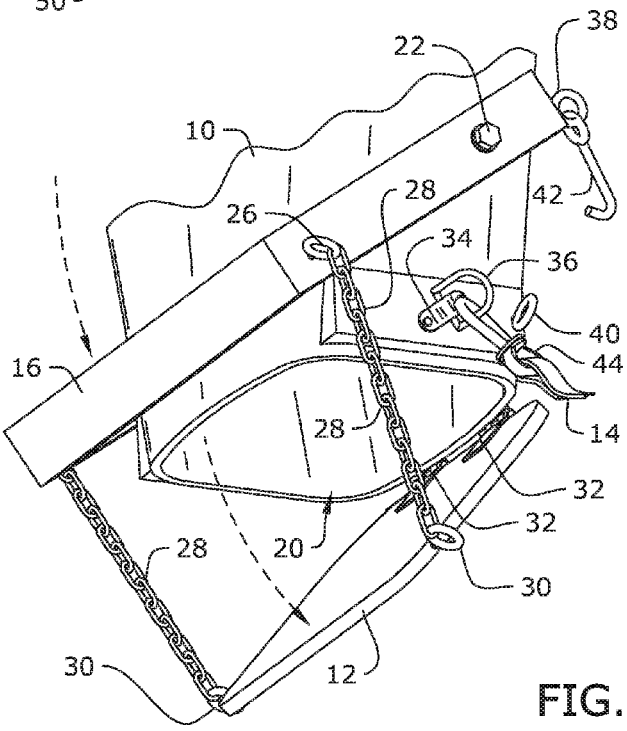
FIG. 7 is a bottom perspective detail view of the invention demonstrated in unlocked and open configuration.
Figure 8:
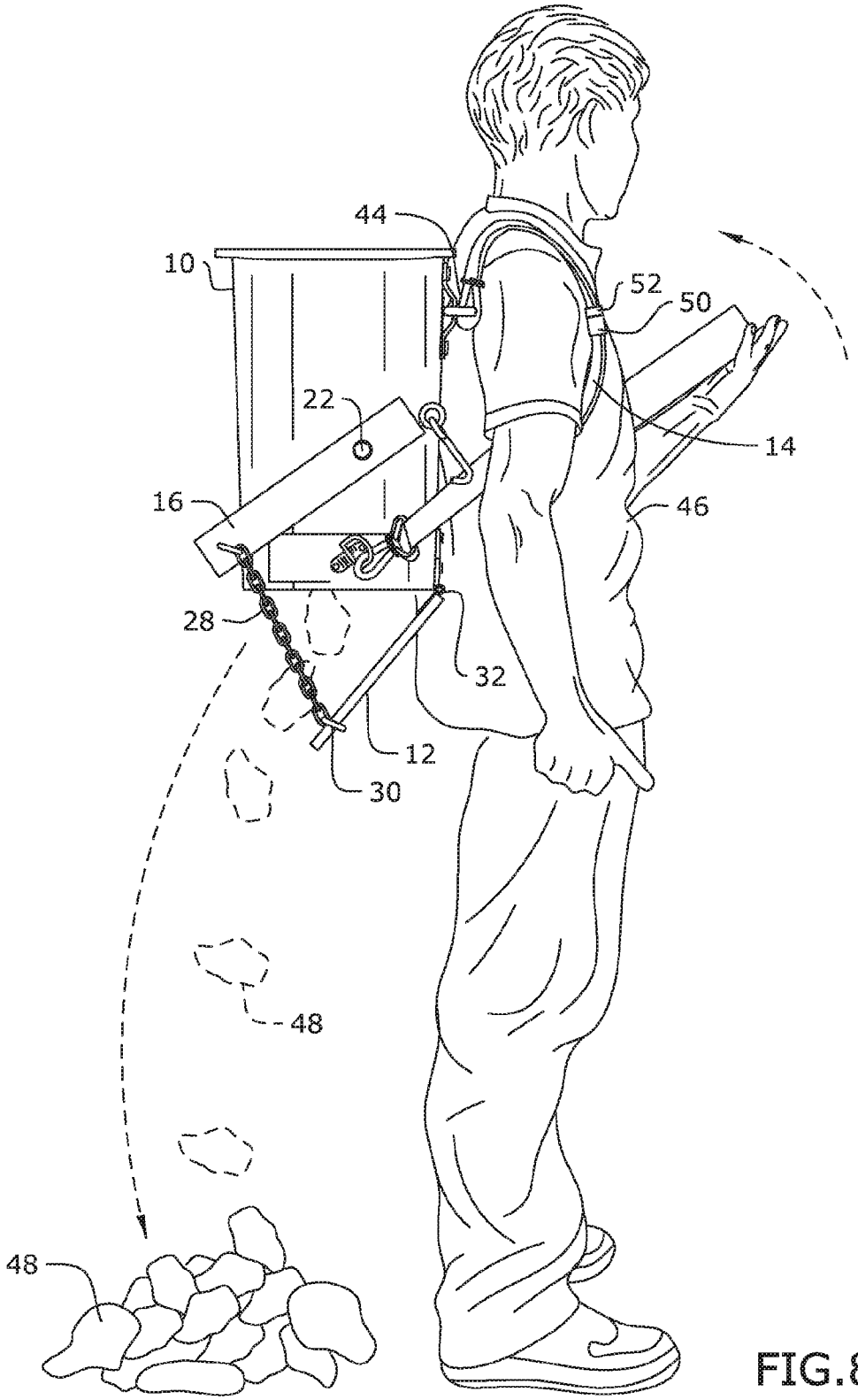
FIG. 8 is a side perspective view of the invention shown in unlocked and open configuration unloading exemplary material.

The U-shaped bar 16 may also include a locking mechanism, such as the non-limiting embodiment shown in reference to FIG. 6, in order to prevent inadvertent actuation of the lever handle 18 until selected by the operator 46. The locking mechanism may comprise an eye 38 operatively attached to a forward end of the U-shaped bar 16, an a hook 42, and a cooperating eye 40 attached to a forward portion of the bucket body 10, such as seen in reference to FIG. 6.

As seen in reference to FIGS. 3, 5, 7, and 8, the bottom plate 12 may be attached to a forward portion of the lower bucket body 10 via one or more hinges 32 to permit the bottom plate 12 to be movable between a closed, containing position and an open emptying position. As seen in reference to FIGS. 7 and 8, the length of the coupling member 28 is preferably selected such the bottom plate 12 is disposed at an angle when the handle lever 18 is moved to the open position, such that the contents 48 carried the bucket may be emptied downwardly and away from the operator 46.

In use, the unit may be place on the operator's 46 back, and supported by the straps 14 like a back pack. The user 46 can now load anything into the unit up to its width opening by, for example, tossing objects over shoulder into unit. The user can travel almost anywhere to reach an intended destination to unload items 48 just by unlocking the locking device that holds the bottom 12 in a closed position. Once unlocked, the user 46 extends the lever 18 and pulls upwardly, which open the bottom door 12 of unit releasing items 48 downward. In most tasks, loading and unloading the unit, user never needs to be remove unit from user body 46 unless items 48 are fragile or delicate.

As will be appreciated, the present invention serves multiple purposes in different fields. For example, a custodian can use the invention to haul litter in large fields of grass such as; parks, airports, landscape, roadside, highways, city sidewalks and streets, apartment complexes, school and college campus grounds, subways, movie theaters, concert and sport events and any public place where litter may accumulate. Instead of dragging a plastic bag in a field, pulling and pushing a trash can or going back and forth to a trash can to empty a dustpan, with this invention a worker can quickly travel long distance, over rough terrain, such as stadium steps, and tight areas without any hassle of an expensive trash can on wheels or fighting with a plastic bag in the wind. In addition the invention will save workers time and trouble, just by tossing the litter in the unit.

Similarly, a construction worker can benefit from the present invention as well. The construction worker can, for example, load and unload bricks, broken materials and debris, haul dirt or sand out of a basement or tight areas without ever removing the unit from the worker's body (back). The worker may toss bricks, broken concrete over their shoulder into the container or use a shovel that works with the unit to pick up dirt, sand, etc. putting it in the unit while still on worker's back. This method allows the operator to load more objects and carry them, hands free, while traveling in tight areas or going up and down stairs or ladders without the fear of falling. Once the worker gets to their destination, such as a dumpster, the operator pulls the lever 18 upward to release whatever objects 48 may be carried in the unit without removing unit from their body, which also saves time because invention replaces the five gallon bucket, wheelbarrow and large trash cans.

In yet another example, an operator 46 can save time when unloading an SUV or a car with loose groceries just by placing a liner in the unit and gently tossing non-fragile groceries into the unit. The present that invention is also an excellent choice for picking up small precious items in the event of a major disaster. Volunteers or victims can bend over and pickup objects by hand without anything falling out of unit while the unit is on their back. In yet another example, the present invention can be used to harvest fruits from a tree or vegetables from a plant, carry equipment or tools for a worker, collect and carry small items in a field of disaster etc.

It should be understood, of course, that the foregoing relates to exemplary embodiments of the invention and that modifications may be made without departing from the spirit and scope of the invention as set forth in the following claims.

What is claimed is:

1. A portable receptacle, comprising:

a receptacle having an first opening defined in a top end and a second opening defined in a bottom end of the receptacle;

a bottom plate hingedly attached to the bottom end of the receptacle and operable between a closed position in which the bottom plate closes the second opening defining a cavity in the receptacle, and an open position;

a lever assembly pivotally attached to a side of the receptacle and operatively connected to the bottom plate to position the bottom plate between the closed position and the open position; and a strap assembly attached between the top end and the bottom end of the receptacle.

2. The portable receptacle of claim 1, the lever assembly further comprising:

a generally U-shaped bar pivotally attached to the receptacle at an intermediate portion of a leg of the U-shaped bar; and a coupling member connecting an aft portion of the U-shaped bar and an aft portion of the bottom plate.

3. The portable receptacle of claim 2, wherein the coupling member comprises a chain.

4. The portable receptacle of claim 2, wherein the coupling member comprises one of: a strap, a cable, a rope, an arm, a rod, or a strap.

5. The portable receptacle of claim 1, further comprising:

a hinge attached between a forward end of the bottom plate and a forward end of the receptacle.

6. The portable receptacle of claim 3, further comprising:

a D-ring attached to a top end of the receptacle and a bottom end of the receptacle; and a hook attaching a first end of the strap assembly to the D-ring at the top end of the receptacle and a second end of the strap assembly to the D-ring at the bottom end of the receptacle.

7. The portable receptacle of claim 3, further comprising:

a locking mechanism operable to secure the lever assembly in the closed position.

8. The portable receptacle of claim 7, wherein the locking mechanism comprises:

a hook and an eye, wherein the hook is attached to the lever assembly and the eye is attached to the receptacle, the hook being operable between a locked position wherein the hook engages in the eye, and an unlocked position wherein the hook is disengaged from the eye.

9. The portable receptacle of claim 8, the lever assembly further comprising:

a handle end hingedly attached to a forward end of the U-shaped bar, the handle movable about the hinge between an extended position and a retracted position.

10. The portable receptacle of claim 8, the strap assembly further comprising:

an adjustable buckle disposed between the first end of the strap and the second end of the strap.

* * * * *